US009289665B2

(12) United States Patent
Muller

(10) Patent No.: US 9,289,665 B2
(45) Date of Patent: Mar. 22, 2016

(54) BASEBALL TRAINING DEVICE

(71) Applicant: Kristopher Muller, Lutz, FL (US)

(72) Inventor: Kristopher Muller, Lutz, FL (US)

( * ) Notice: Subject to any disclaimer, the term of this patent is extended or adjusted under 35 U.S.C. 154(b) by 270 days.

(21) Appl. No.: 13/872,211

(22) Filed: Apr. 29, 2013

(65) Prior Publication Data

US 2014/0323248 A1 Oct. 30, 2014

(51) Int. Cl.
*A63B 69/00* (2006.01)
*A63B 71/02* (2006.01)

(52) U.S. Cl.
CPC ..... *A63B 69/0002* (2013.01); *A63B 71/023* (2013.01); *A63B 2069/0008* (2013.01); *A63B 2225/093* (2013.01)

(58) Field of Classification Search
CPC ..... A63B 71/023
USPC ..... 473/423, 429–430; 248/219.1, 219.4, 248/220.21, 220.31
See application file for complete search history.

(56) References Cited

U.S. PATENT DOCUMENTS 1,408,900 A * 3/1922 Miller ..... F16M 13/02 248/230.8
2,976,040 A * 3/1961 Bales ..... 473/429
4,010,950 A 3/1977 Visockis
4,049,126 A * 9/1977 Halverson ..... 211/104
4,050,694 A 9/1977 Domroski
4,744,537 A * 5/1988 Buckley ..... F16M 13/02 211/107
4,793,612 A 12/1988 Hammond
5,000,450 A * 3/1991 Beintema ..... 473/429
5,178,384 A * 1/1993 Gorman ..... 473/451
5,244,392 A 9/1993 Maursetter
5,271,618 A 12/1993 Malwitz
5,294,005 A * 3/1994 Hedges ..... 211/85.7
5,337,986 A * 8/1994 Vollink ..... A47G 7/045 211/107
5,386,986 A 2/1995 Gamboa
5,458,326 A 10/1995 Marcyes
5,624,113 A 4/1997 Rabine
5,662,537 A * 9/1997 Zuber ..... 473/426
5,755,630 A 5/1998 Malwitz
5,989,137 A * 11/1999 Krueger ..... 473/423
6,290,618 B1 * 9/2001 Ring ..... 473/429
6,322,460 B1 11/2001 Asci
7,115,051 B2 * 10/2006 Hansberry ..... 473/423
D606,136 S * 12/2009 Gamboa ..... D21/719
7,740,143 B2 * 6/2010 White ..... 211/85.7
8,012,047 B2 * 9/2011 Gamboa ..... 473/442
8,371,457 B2 * 2/2013 Entz ..... 211/85.7
2001/0030270 A1 * 10/2001 Hartl ..... A47G 7/045 248/219.1
2003/0094553 A1 * 5/2003 Mullis ..... A01M 31/00 248/219.4
2006/0003854 A1 * 1/2006 Hansberry ..... 473/423
2013/0157785 A1 * 6/2013 Connors ..... 473/429

* cited by examiner

*Primary Examiner* — Melba Bumgarner
*Assistant Examiner* — Laura L Davison
(74) *Attorney, Agent, or Firm* — Mitchell J. Mehlman, Esq.

(57) ABSTRACT

A portable training apparatus for assisting a user in developing ball batting skills is provided for use by either right or left handed batters. The apparatus releasably attaches to an existing structure, such as a chain-link fence. A post has a foot and a plurality of stabilizing members for attaching the post to a fence. A rotational means supplies the user a ball to hit.

14 Claims, 4 Drawing Sheets

BASEBALL TRAINING DEVICE

FIELD OF THE INVENTION

A portable training apparatus for assisting a user in developing ball batting skills is provided and may be utilized by either right or left handed batters. More particularly, the apparatus releasably attaches to an existing fence, such as a chain-link fence, and includes a member having a ball that is attached to the member by a rotational means that supplies the user a ball to hit.

DESCRIPTION OF THE BACKGROUND ART

Several related devices have been found in the prior art that comprise baseball hitting trainers. However, most of these devices are structurally complex, incorporate self-supporting elements, are not readily transportable or require significant time for assembly or disassembly.

More particularly, U.S. Pat. No. 2,976,040 is directed to a practice tether ball device comprising a vertical support, a horizontal arm clamped to the vertical support, a flexible member connected to a ball and to a ball bearing race ring at the end of the horizontal arm.

U.S. Pat. No. 4,010,950 is directed to a baseball batting practice apparatus including a shaft for detachable connection to a vertical wall and a pair of rotatable elements mounted thereon. A ball is suspended from a hub section. Striking of the ball causes it to rotate on the hub. This device includes a complex gear mechanism.

U.S. Pat. No. 4,050,694 discloses a baseball batting practice kit containing a flexible ball tether suspended from a horizontal arm. One end of the horizontal arm is attached to a vertical column which is supported by a hollow base.

U.S. Pat. No. 4,793,612 discloses a device for practicing and teaching ball batting characterized by use of a rotary member journaled for rotation about a shaft, in which a flexible linkage affixes a ball, nominally a baseball, in a down-hanging position from the rotary member. A backboard mounts the rotary member to a vertical post. The backboard is maintained upon the post by "U" bolts.

U.S. Pat. No. 5,244,392 is directed to a portable batting apparatus which can be installed on a pole or a wall. The apparatus comprises a steel channel means for abutting against a generally vertical surface. A swivel bracket is slipped over a steel bolt at the end of the tube and held between two washers, a coil spring and a lock nut. A practice ball is suspended by a plastic covered rope from the swivel bracket.

U.S. Pat. No. 5,271,618 is directed to a batting practice device attachable to various existing permanent fixtures. A shock absorbing mount is releasably attached to a structure along the length of the structure with a portion extending beyond the length of the structure in a cantilever manner.

U.S. Pat. No. 5,386,986 is directed to a batting practice device having a base which may be secured to a chain-link fence, an adjustable-length rigid arm fixed to a base and extending generally perpendicularly thereto, and a tethered free-swinging ball supported from an end of the rigid arm opposite the base. The device requires a complex base assembly comprising a stabilizing crossbar and an elastic band.

U.S. Pat. No. 5,458,326 is directed to a batting practice apparatus that employs a cyclone fence. A rigid, horizontal arm is detachably secured at one end to the top of the fence. A tether passes horizontally through the ball at a location confronting the fence. When the tether is attached to the fence at each end in a taut state, the ball is maintained at the adjusted height along a shock cord.

U.S. Pat. No. 5,624,113 is directed to a batting practice system having a base flange which can be attached to a chain link fence or a support pole. The device includes a vertical shock cord connected to one end of a rigid horizontal support and anchored at the other end thereto. A batting practice means, such as a ball, is movable along the shock cord to adjust the height for practice.

U.S. Pat. No. 5,755,630 is directed to a batting practice device that is attachable to an existing permanent fixture. The device includes a mounting bracket attachable to the fixture, the bracket supporting a receiving tube. The tube has an opening for interlockably receiving a rod with a portion extending from the bracket in a cantilevered horizontal fashion. A metal bushing is rotatably mounted and captured on the rod portion extending from the plate.

U.S. Pat. No. 6,322,460 is directed to a batting practice device comprising a resiliently flexible and elongate retaining rod, a target member, such as a ball, is coupled to a distal end of the elongate retaining rod. The device includes a clamping structure for clamping the proximal end of the elongate retaining rod to an environmental structure, such as a fence.

The improvements of the present invention require that particular attention be given to certain elements of such prior art apparatus. For example, the present invention does not require a free standing base or complex means for attachment to a fence. In this way the device can be easily attached to and detached from a fence and conveniently transported in a standard bat bag.

Further, as will be appreciated by ball players and others, most ball fields do not allow practice hitting against fences due to the high risk of damage to the fences from the impact of batted balls. The present invention solves this and other problems.

As such, such prior art devices have proven to be costly, heavy, complex, difficult to transport, difficult to assemble using tools, or erect on a fence, and thereby have proven generally unsuitable for widespread use.

SUMMARY OF THE INVENTION

In one aspect of the present invention a baseball training device for attaching to a fence comprises a post. The post can have a body including a first end, and a second end connected to a mounting foot for mounting to a fence, and at least one aperture therethrough. A rotator can be rotatably mounted to the first end of the post. A cord includes a first end being attached to the rotator and a second end being attached to a ball. A plurality of stabilizing members each has a first end and a second end. The plurality of first ends can be connected to the post. The plurality of second ends can be attached to a plurality of releasable connectors for connecting to a fence.

In some embodiments, the at least one aperture comprises a first aperture and a second aperture for connecting the plurality of stabilizing members to the post.

In other embodiments, the plurality of stabilizing members comprises three stabilizing members.

In some embodiments, the mounting foot can be a U-shaped member for engaging the fence In other embodiments, the rotator can be a wheel.

In yet other embodiments, the cord comprises a polymer rope.

In certain embodiments, the ball can be a baseball.

In certain other embodiments, the plurality of stabilizing members can include three stabilizing members.

In yet other embodiments, the stabilizing members comprise metallic cables.

In some embodiments, the plurality of connectors can be three connectors.

In certain embodiments, the connectors can be carabiners.

In another aspect of the invention, a baseball training device comprises a post having a body. The body can include a first end, a second end, a first aperture and a second aperture each extending through the body of the post. A U-shaped mounting foot can be connected to the second end of the post. A rotating member can be rotatably mounted to the first end of the post. A cord includes a first end attached to the rotating member, and a second end attached to a ball. A first stabilizing member, a second stabilizing member, and an third stabilizing member, each having a first end and a second end. The first and the second stabilizing members can be connected through the first aperture extending through the body of the post. The third stabilizing member can be connected through the second aperture extending through the body of the post. The second end of the first, the second, and the third stabilizing members each can be attached to a releasable connector. The releasable connectors can be attached to a fence, thereby forming a stable structure for batting practice.

In some embodiments of this aspect, the releasable connectors can be carabiners.

In still other embodiments, the rotating member can include at least one aperture and one fastener for mounting the rotator to the first end of the post.

In one embodiment of this aspect, the rotating member can include an aperture therethrough. The first end of the cord can extend through the aperture. The cord can include a first terminal knot, thereby securing the first end of the cord to the retaining member.

In another embodiment the ball can include an aperture therethrough. The second end of the cord extends through said aperture. The cord includes a terminal knot, thereby securing the second end of the cord to the ball.

In yet another aspect of the invention, a method of batting practice comprises engaging a post having a longitudinal axis with a fence. The post has a first end and a second end. The second end has a ball rotatably mounted thereon. The first end having a foot for engaging the fence. The post includes a first, a second, and a third stabilizing member for connected the post to the fence. The stabilizing members are attached to the fence. The ball can be hit by a batter thereby causing the ball to rotate at least 360 degrees around the longitudinal axis of the post.

In one embodiment of this aspect, the ball can be a baseball or a softball.

In certain embodiments, the fence can be a chain-link fence.

DETAILED DESCRIPTION

As used herein, a chain-link fence (also referred to as wire netting, wire-mesh fence, chain-wire fence, cyclone fence, hurricane fence, or diamond-mesh fence) is a type of woven fence usually made from galvanized or LLDPE-coated steel wire. The wires run vertically and are bent into a zigzag pattern so that each "zig" hooks with the wire immediately on one side and each "zag" with the wire immediately on the other. This forms the characteristic diamond pattern seen in this type of fence.

As used herein, the term ball is defined as a round or roundish body, of various sizes and materials, either hollow or solid, for use in games. The term baseball is used to mean any type of ball which would assist a batter in developing hitting skills. This includes balls that do not meet major league baseball's specifications for size, shape, weight, or material. It may be advantageous to practice for example with a smaller or a larger ball, or using a major league baseball. The major league baseball must be made with 108 stitches, must weigh about 5 ounces, and is generally about 9 inches in circumference.

As used herein, the term karabiner or carabiner includes a shaped ring with or without a spring catch on one side, used for fastening stabilizing members to a fence or other suitable structure. The carabiner may include a spring or screw type mechanism for closing the ring to prevent accidental disengagement and allow for purposeful engagement and disengagement. The carabiner is defined herein as any releasable ring for connecting a stabilizing member to a fence.

FIGS. 1-4 depict one non-limiting embodiment of baseball training device 10 as it is mounted to a cyclone fence 12. The training device 10 is designed to easily attach and detach from an existing fence, as will be found in many schoolyards, homes, and other places where baseball is commonly practiced or played without the use of tools.

In this embodiment, the training device is portable and ergonomically designed for human factors. Such factors allow a user to control the height and location of the device to allow users of differing heights and abilities to mount the unit in a location which will present the user with a ball to hit at virtually any vertical position.

As shown in FIGS. 1-4, one non-limiting embodiment of the training device 10 includes post 16. Post 16 can have a cylindrical body. Non-cylindrical posts are contemplated to be within the scope of the instant invention.

Figure 1:
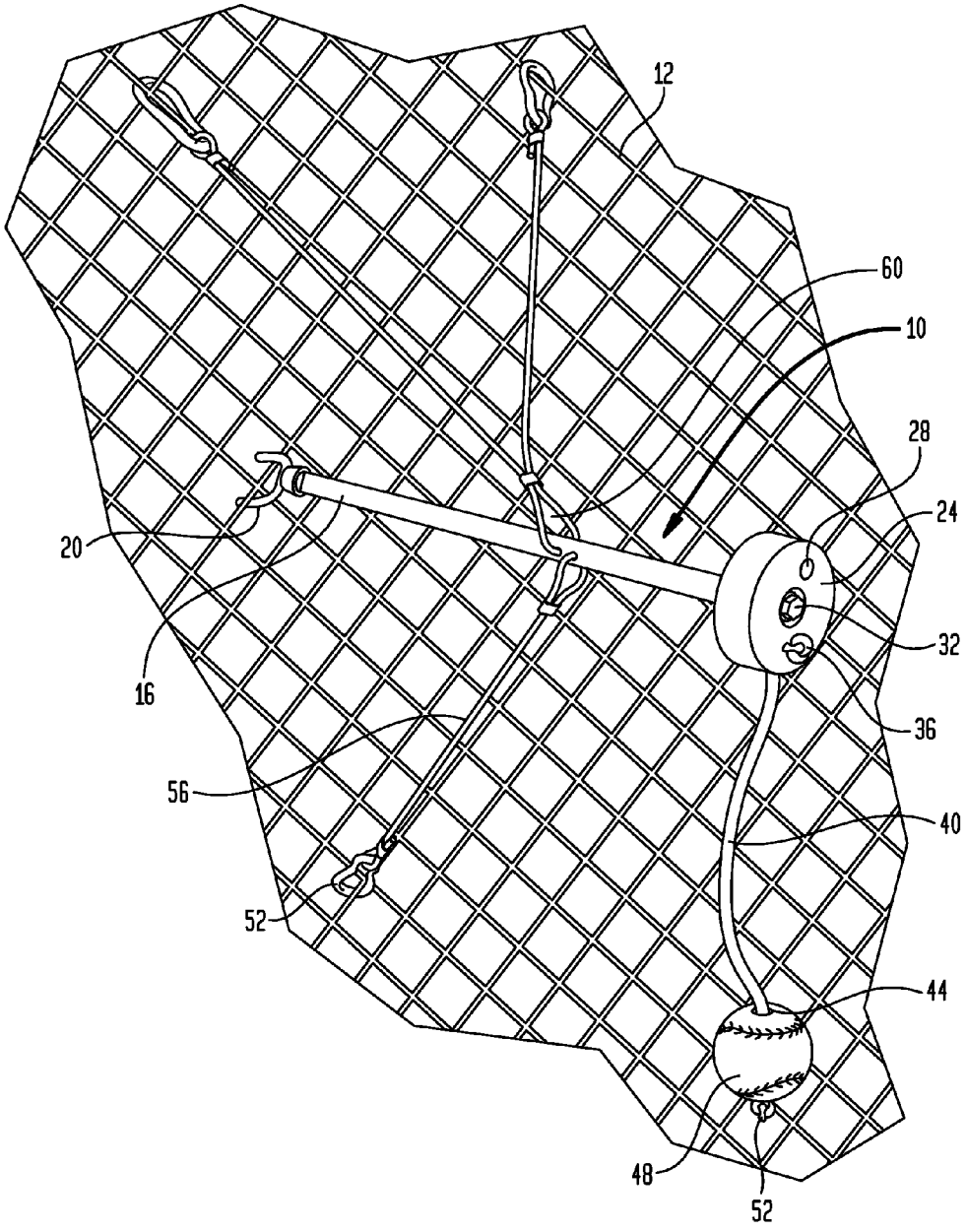
FIG. 1 depicts a front perspective view of a baseball training device mounted to a fence according to one non-limiting embodiment of the present invention.
Figure 2:
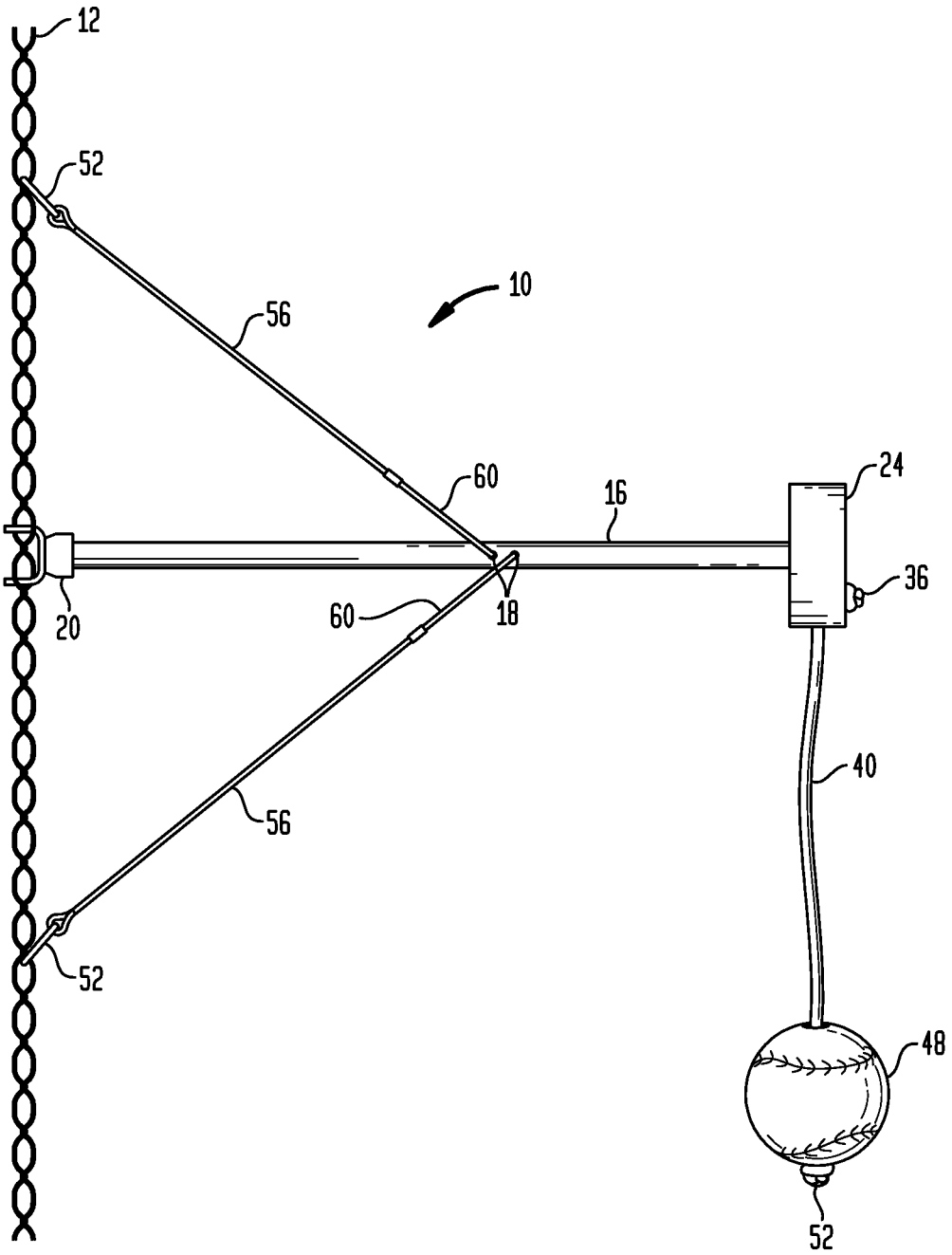
FIG. 2 shows a side view of some of the elements included in the baseball training device of FIG. 1.

The post 16 includes apertures 18 such that stabilizers 56 can be secured to the post 16 through the apertures 18, for example by stabilizer loop 60 and also to fence 12 by connectors 52. In this embodiment, there are two apertures, each aperture creating a through-hole in the post for attachment of the three stabilizers. Referring to FIG. 1, for example, two stabilizers are looped through one aperture on post 16 and a third stabilizer is looped through the second aperture in the post.

Connectors 52 can be carabiners, for example, metal loops having gates used to quickly and reversibly connect components in safety critical systems. The gates can be spring loaded.

Further, configurations which include other known attachment means can be used to secure the stabilizers 56 to the inside or outside of post 16 and the connectors 52 to the stabilizers 56 or the fence 12.

Post 16 includes foot 20 for engaging fence 12. In this embodiment, foot 20 is configured in a U shape. The foot 12 engages the fence and prevents the post from becoming dislodged during use by engaging the supporting structure of the fence, such as the metal wires in a chain-link fence. Other foot configurations for engaging the fence, such as, for example, three, four, or more prong configurations are contemplated to be within the scope of the present invention.

A rotator such as wheel 24 is mounted to the opposite end of post 16 from the foot 20. The wheel can include at least one aperture 28 and a mounting fastener 32. The wheel assembly is mounted to the post 16 so that it can freely rotate in a plane substantially perpendicular to the post and parallel with the fence 12. An axle or bearings, such as ball bearings, needle bearings and the like (not shown) can be used to mount the wheel 24 to the post 16. Any known means for rotatably mounting a wheel on a post are contemplated to be within the scope of the invention.

Cord 40 can include first terminal knot 36 and can be threaded through aperture 28 in order to secure one end of cord 40 to wheel 24 such that cord 40 exits wheel 24 at or near the centerline of the wheel. That is, cord 40 traces a substantially 90 degree path within aperture 28 through the wheel 24 such that cord 40 is substantially perpendicular to post 16 and parallel to fence 12 when it exits the wheel.

The opposite end of cord 40 can be threaded through aperture or through-hole 44 in a ball 48 and secured by a knot 52. Other known conventional mechanical means to secure one end of the cord to the wheel and the other end to the ball are contemplated to be within the scope of the invention. The cord is positioned to present a batter 76 with a ball in an optimum hitting position for practice. The length of the cord, and the height of the device when mounted to a fence, can be adjusted to accommodate a wide range of batter needs.

The cord can be fashioned from any flexible or semi-rigid material such as rope, fiberglass, aramid fiber, carbon fiber, braided metal and the like. The cord can be elastic or rigid. It will be known to those in the art that the cord material will have sufficient tensile strength and durability for proper operation of the device and for long term durability.

In some embodiments, the cord can include a protective sheath, covering all or part of the cord for abrasion resistance, safety and durability. The protective sheath can comprise a polymeric material.

In use, the training device can be assembled and disassembled in the field, or wherever a suitable fence is available. In this non-limiting embodiment, no tools are required. The user engages foot with the fence. While supporting the post, the user can attach each of the stabilizers to the fence in a roughly triangular pattern, that is, about 120 degrees apart. Any pattern of stabilizers that maintains a stable structure may be utilized. Ideally, the top stabilizer is connected first to remove the gravitational load off the post. The other stabilizers can be fastened to the fence in any order. In this way, the stabilizers act on the post to form a stable tripod structure which maintains the post substantially perpendicular to the fence or other suitable mounting surface.

Once attached, one or more stabilizers can be easily repositioned to optimize the tension in the stabilizers. Such optimization may be desirable in order to maintain the device in a stable, optimal position for use.

Figure 4:
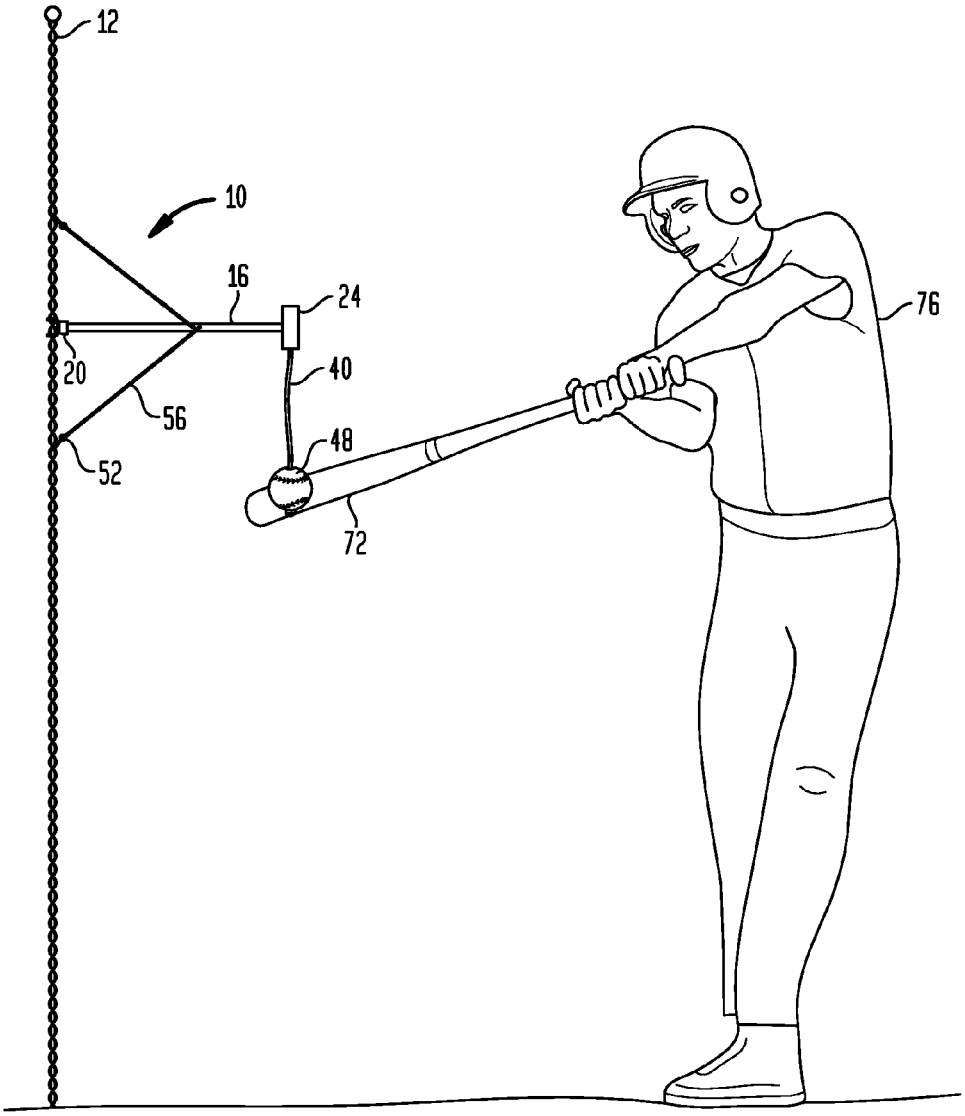
FIG. 4 is another side view of some of the elements included in the baseball training device of FIG. 1 depicting a batter using a bat for baseball training.

As shown in FIG. 4, when the stabilizers 56 and foot 20 are securely attached to the fence using connectors 52, the device is self-supporting and ready for batter 76 to hit ball 48 with bat 72.

Figure 3:
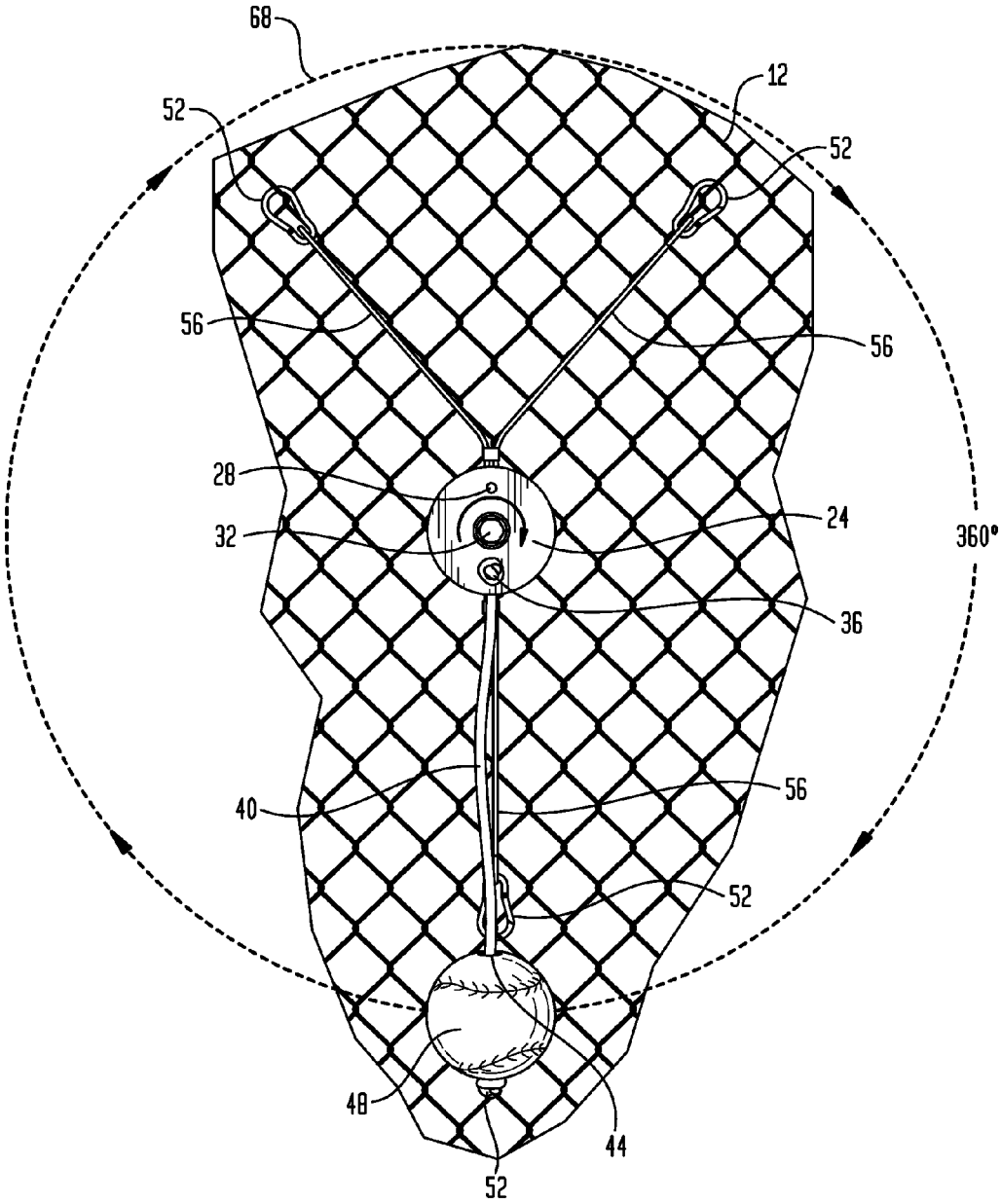
FIG. 3 is front view of some of the elements included in the baseball training device of FIG. 1.

Striking the ball with a bat causes the ball, the cord and the wheel to rotate in a 360 circular path 52 as shown in FIG. 3, until the energy is dissipated and the wheel stops or the batter strikes again. The ball can be hit repeatedly to develop the batter's skills or to warm up before a game. When at rest, the ball will hang in a stable downward hitting position due to gravitational forces acting on the device.

When the device is no longer required, it can be easily disconnected by disengaging the stabilizers and the foot from the fence.

All structural components of the device can be molded or fabricated from any suitable durable structural materials, for example, a metal or polymeric material. Suitable materials and manufacturing methods will be well known to those skilled in the art of structural, mechanical or materials engineering.

A plurality of post geometries, stabilizer means, and attachment means are contemplated within the scope of the present invention. Such post geometries, stabilizer means and attachment means will be well known to those of skill in the mechanical arts.

Although the invention herein has been described with reference to particular embodiments, it is to be understood that these embodiments are merely illustrative embodiments and that other arrangements may be devised without departing from the spirit and scope of the present invention as defined by the disclosure herein.

What is claimed is:

1. A baseball training device for attaching to a wire mesh fence comprising:

(a) a post, said post having a body, said body including a first end, a second end, and at least one aperture therethrough, said second end comprising a U-shaped mounting foot having two distal ends for extending through said wire mesh fence and for mounting said post substantially perpendicular to said wire mesh fence, wherein said distal ends are substantially parallel to each other and can protrude through a wire mesh portion of said wire mesh fence in a direction away from said body, said distal ends remaining substantially disconnected from said fence during installation and use of said device;

(b) a rotator, said rotator being rotatably mounted to said first end of said post;

(c) a cord, said cord including a first end connected to said rotator and a second end connected to a ball; and (d) a plurality of stabilizing cables, said plurality of stabilizing cables each having a first end and a second end, said plurality of first ends being attached to said post through said at least one aperture, said plurality of second ends being attached to a plurality of releasable connectors for connecting said device to said fence, wherein said plurality of cables includes at least three cables which can be connected to said wire mesh portion of said fence in a direction substantially opposing one another thereby forming a tripod configuration for maintaining said post in a stable position substantially perpendicular to said fence.

2. The device of claim 1, wherein said rotator comprises a wheel.

3. The device of claim 1, wherein said cord comprises a rope.

4. The device of claim 1, wherein said ball comprises a baseball.

5. The device of claim 1, wherein said releasable connectors are carabiners.

6. The device of claim 1, wherein said releasable connectors are spring type carabiners.

7. A baseball training device comprising:

(a) a post, said post having a body, said body including a first end, a second end, a first aperture and a second aperture extending though said body of said post;

(b) a U-shaped mounting foot, said mounting foot being connected to said second end of said post, said U-shaped mounting foot being substantially parallel to the longitudinal axis of said post body, said U-shaped mounting foot having two arms, each of said arms including a proximal portion and a distal portion and being configured to allow said two arms to extend through a wire mesh cyclone fence thereby stabilizing said post during and after installation of said device to said fence, wherein said arms are substantially parallel to each other and can protrude through said wire mesh cyclone fence in a direction away from said body, said arms remaining substantially disconnected from said fence during installation and use of said device;

(c) a rotating member, said rotating member being rotatably mounted to said first end of said post;

(d) a cord, said cord including a first end being attached to said rotating member and a second end being attached to a ball; and (e) a first stabilizing cable, a second stabilizing cable, and a third stabilizing cable, said first, said second, and said third stabilizing cables each having a first end and a second end, said first and said second stabilizing cables being connected through said first aperture extending through said body of said post, said third stabilizing cable being connected through said second aperture extending through said body of said post, said second end of said first, said second, and said third stabilizing cables each being attached to a releasable connector, wherein said releasable connectors are attachable to said fence, wherein said stabilizing cables are connected to said wire mesh cyclone fence in a tripod-like configuration for maintaining said post in a stable arrangement being substantially perpendicular to said wire mesh cyclone fence thereby forming a stable structure for batting practice.

8. The device of claim 7, wherein said releasable connectors comprise carabiners.

9. The device of claim 7, wherein said rotating member includes at least one aperture, said rotating member being attached to said first end of said post with a fastener.

10. The device of claim 7, wherein said rotating member includes an aperture therethrough, said first end of said cord extending through said aperture, said cord including a first terminal knot, thereby securing said first end of said cord to said rotating member.

11. The device of claim 7, wherein said ball includes an aperture therethrough, said second end of said cord extending through said aperture, said cord including a second terminal knot, thereby securing said second end of said cord to said ball.

12. A method of batting practice comprising:

(a) engaging a post having a longitudinal axis with a chain-link fence, said post comprising a first end and a second end, said first end having a ball rotatably mounted thereon, said second end having a U-shaped foot for extending through said chain-link fence, said U-shaped mounting foot having two distal ends for extending through said fence and mounting said post substantially perpendicular to said fence, wherein said distal ends are substantially parallel to each other and can protrude through said fence in a direction away from said body, said distal ends remaining substantially disconnected from said fence during installation and use of said device; said post including a first, a second, and a third stabilizing cable connected thereto;

(b) attaching said first stabilizing cable to said chain-link fence;

(c) attaching said second stabilizing cable to said chain-link fence;

(d) attaching said third stabilizing cable to said chain-link fence, wherein said first, said second and said third stabilizing cables are connected to said chain-link fence in a tripod configuration for maintaining said post in a stable arrangement, wherein said post is supported substantially perpendicular to said fence; and (e) hitting said ball thereby causing said ball to rotate at least 360 degrees around said longitudinal axis of said post.

13. The method of claim 12, wherein said ball is a baseball.

14. A baseball training device for attaching to a chain-link wire mesh fence comprising:

(a) a post, said post having a body, said body including a first end, a second end, and a first and a second aperture therethrough, said second end comprising a U-shaped mounting foot having two distal ends for extending through said wire mesh fence and mounting substantially perpendicular to said fence, wherein said distal ends being substantially parallel to each other can protrude through a wire mesh portion of said fence in a direction away from said body and thereby remain substantially disconnected from said fence during installation and use of said device;

(b) a rotator, said rotator being rotatably mounted to said first end of said post;

(c) a cord, said cord including a first end connected to said rotator and a second end connected to a baseball; and (d) four stabilizing cables, said four stabilizing cables each having a first end and a second end, two of said first ends are attached to said post through said first aperture and two of said first ends are attached to said post through said second aperture, said second ends each being attached to a carabiner for releasably connecting each of said stabilizing cables to said fence, wherein a first two of said cable second ends are attached to said fence in a direction substantially opposite to a second two of said cable second ends, thereby creating a stable configuration comprising said four cables and said post thereby supporting said post substantially perpendicular to said wire mesh portion of said fence.

* * * * *